US008147359B2

(12) United States Patent
Ng

(10) Patent No.: US 8,147,359 B2
(45) Date of Patent: Apr. 3, 2012

(54) SHUTTLECOCK

(76) Inventor: Yik Sheung Ng, Kwai Chung (HK)

( * ) Notice: Subject to any disclaimer, the term of this patent is extended or adjusted under 35 U.S.C. 154(b) by 0 days.

(21) Appl. No.: 13/020,837

(22) Filed: Feb. 4, 2011

(65) Prior Publication Data

US 2012/0040786 A1 Feb. 16, 2012

(51) Int. Cl.
*A63B 67/18* (2006.01)

(52) U.S. Cl. ..... 473/579

(58) Field of Classification Search ..... 473/579, 473/580

See application file for complete search history.

(56) References Cited

U.S. PATENT DOCUMENTS

| | | | | |
|---|---|---|---|---|
| 2,911,219 | A * | 11/1959 | Arokiasamy | 473/580 |
| 3,901,509 | A * | 8/1975 | Liong | 473/580 |
| 4,813,686 | A * | 3/1989 | Miranda | 473/580 |
| 5,265,886 | A * | 11/1993 | Hum | 473/579 |
| 6,780,130 | B1 * | 8/2004 | Monochello | 473/570 |

FOREIGN PATENT DOCUMENTS

| | | | |
|---|---|---|---|
| CN | 2165891 | Y | 5/1994 |
| CN | 2320289 | Y | 5/1999 |
| CN | 2332437 | Y | 8/1999 |
| CN | 2396848 | Y | 9/2000 |
| CN | 200984433 | Y | 12/2007 |
| GB | 190525803 | | 0/1905 |

* cited by examiner

*Primary Examiner* — John Ricci
(74) *Attorney, Agent, or Firm* — Donald J. Ersler

(57) ABSTRACT

A shuttlecock preferably includes a tail, a shuttle housing and an impact head. The tail includes at least three tail sections which are attached to each other and retained by a tail base. The shuttle housing preferably includes a first housing half, a second housing half and an electrical circuit. The electrical circuit preferably includes a circuit board, an vibration sensor, at least one light emitting device and a sound emitting device. The circuit board includes an electrical controller and a battery. The vibration sensor detects that the shuttlecock is in motion and sends an electrical signal to the electrical controller, which activates the at least one light emitting device and/or the sound emitting device, until the shuttlecock is no longer in motion. The impact head preferably includes a plurality head discs, a plurality of buffer discs and a disc strap.

15 Claims, 5 Drawing Sheets

SHUTTLECOCK

CROSS-REFERENCES TO RELATED APPLICATIONS

This is a utility patent application taking priority from Chinese utility model no. 201020293490.6 filed on Aug. 16, 2010.

BACKGROUND OF THE INVENTION

1. Field of the Invention

The present invention relates generally to games and more specifically to a shuttlecock, which may be struck with a hand, a foot or a racket.

2. Discussion of the Prior Art

It appears that the prior art does not disclose a shuttlecock, which includes an impact head, which is large enough for hitting by a hand, or kicking by a foot. A game of shuttlecock may be played by one or more persons. A game of kicking the shuttlecock requires kicking, maneuvering and controlling skill for the shuttlecock to stay in the air as long as possible. The shuttlecock may also be struck with a racket. Great Britain patent document no. GB190525803 to Sibbring discloses an improved shuttlecock. China patent document no. CN 2165891 Y to Li discloses a musical shuttlecock. China patent document no. CN 2320289 Y to Zhang discloses a flashing shuttlecock with electronic music. China patent document no. CN 2332437 Y to Jiao discloses a luminous shuttlecock. China patent document no. CN 2396848 Y to Qin discloses a body-building shuttlecock. China patent document no. CN 200984433 Y to Zheng discloses a shuttlecock having displaying device.

Accordingly, there is a clearly felt need in the art for a shuttlecock, which may be struck with a hand, a foot or a racket.

SUMMARY OF THE INVENTION

The present invention provides a shuttlecock, which may be hit by a hand, struck with a foot or a racket. The shuttlecock preferably includes a tail, a shuttle housing and an impact head. A second embodiment of the shuttlecock preferably includes the tail and the impact head. The tail includes at least three tail sections which are attached to each other. An end of each tail section is retained by a tail base. The shuttle housing preferably includes a first housing half, a second housing half and an electrical circuit. The electrical circuit preferably includes a circuit board, an vibration sensor, at least one light emitting device and a sound emitting device. The circuit board includes an electrical controller and a battery. The at least one light emitting device and the sound emitting device are preferably mounted on the circuit board. The vibration sensor detects that the shuttlecock is in motion and sends an electrical signal to the electrical controller. In response to the electrical signal, the electrical controller activates the at least one light emitting device and/or the sound emitting device, until the shuttlecock is no longer in motion. The impact head preferably includes a plurality head discs, a plurality of buffer discs and a disc strap. At least one buffer disc may be inserted between two head discs. The disc strap is used to hold the plurality of head discs and buffer discs to together in one unit.

Accordingly, it is an object of the present invention to provide a shuttlecock, which may be struck with a foot or a racket.

These and additional objects, advantages, features and benefits of the present invention will become apparent from the following specification.

DETAILED DESCRIPTION OF THE PREFERRED EMBODIMENTS

Figure 1:
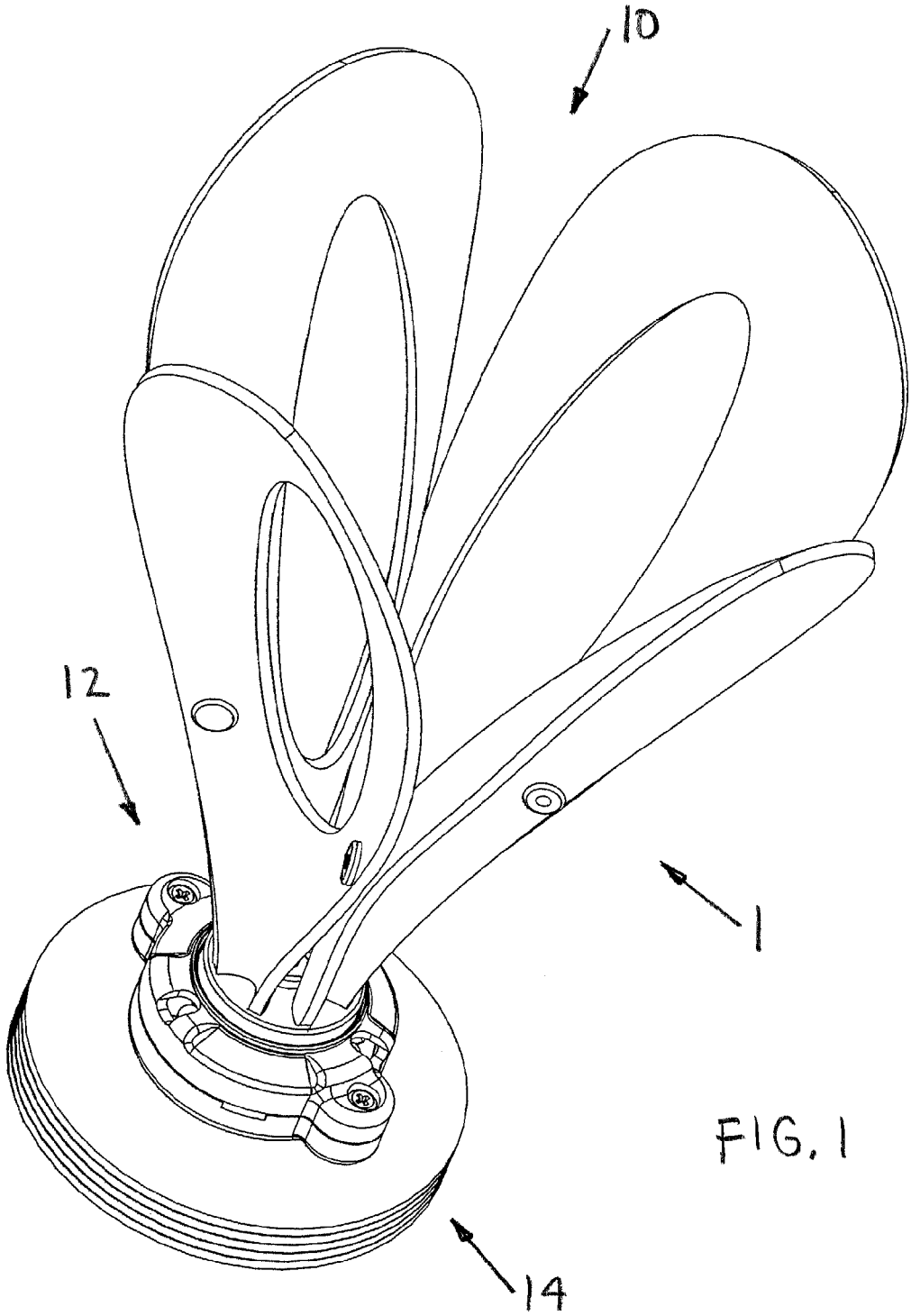
FIG. 1 is a perspective view of a shuttlecock in accordance with the present invention.
Figure 2:
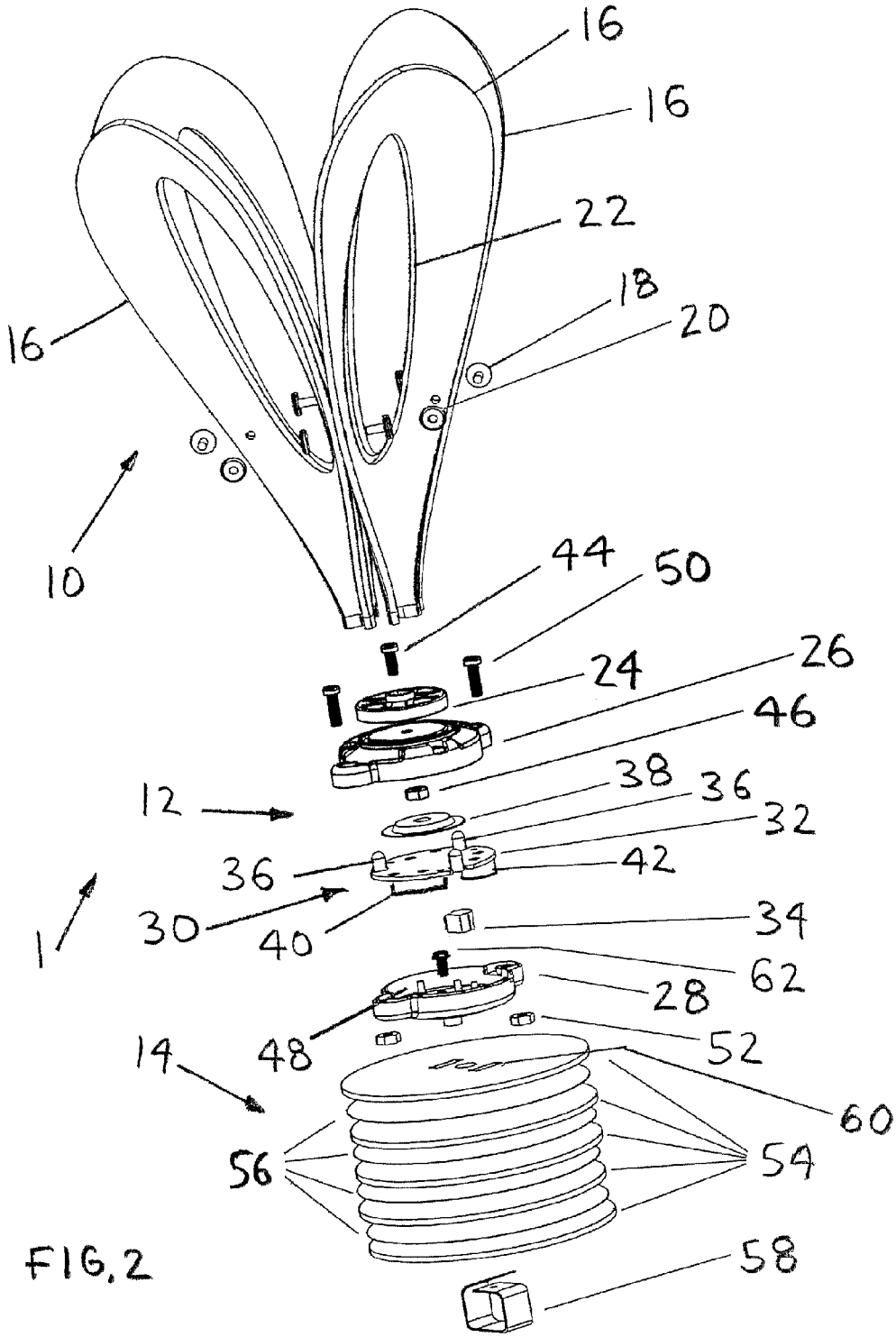
FIG. 2 is an exploded perspective view of a shuttlecock in accordance with the present invention.

With reference now to the drawings, and particularly to FIG. 1, there is shown a perspective view of a shuttlecock 1. With reference to FIG. 2, the shuttlecock 1 preferably includes a tail 10, a shuttle housing 12 and an impact head 14. The tail 10 preferably includes at least three tail sections 16. Each tail section 16 is preferably attached to an adjacent tail section 16 along a length thereof with at least one lock pin 18 inserted into at least one lock pin base 20. Each tail section 16 preferably includes at least one opening 22 to reduce weight and improving aerodynamics. An end of each tail section 16 is retained in a tail base 24 by press-fit, adhesive or any other suitable method. Each tail section 16 may be fabricated from ethylene vinyl acetate (EVA), expanded polystyrene foam or any other suitable lightweight material. The shuttle housing 12 preferably includes a first housing half 26, a second housing half 28 and an electrical circuit 30.

Figure 3:
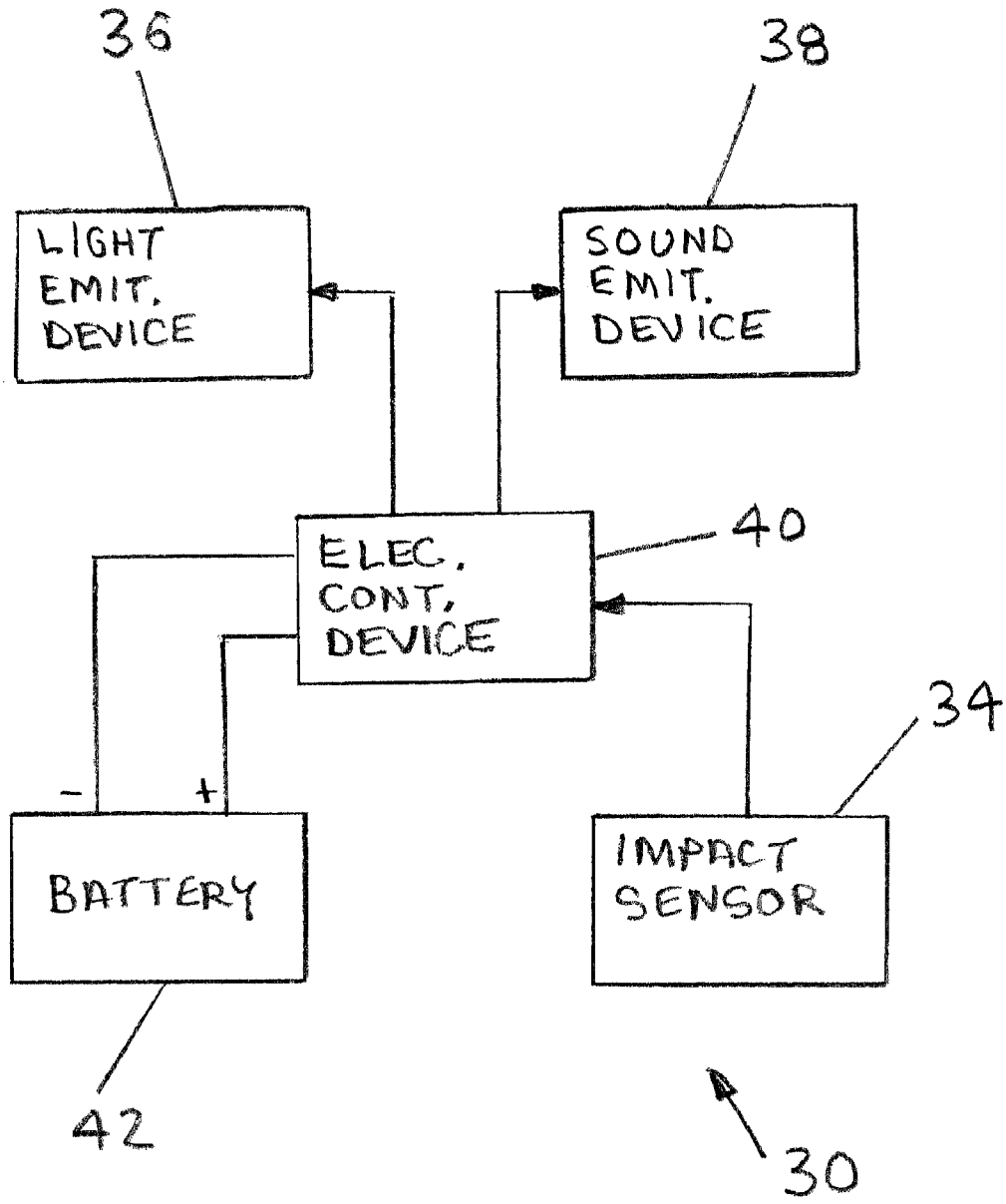
FIG. 3 is a schematic diagram of an electrical circuit of a shuttlecock in accordance with the present invention.

With reference to FIG. 3, the electrical circuit 30 preferably includes a circuit board 32, an vibration sensor 34, at least one light emitting device 36 and a sound emitting device 38. The circuit board 32 includes an electrical controller 40 and a battery 42. The electrical controller 40 is preferably a microprocessor, but other devices or circuits may also be used. The at least one light emitting device 36 and the sound emitting device 38 are preferably mounted on the circuit board 32. The light emitting device 36 is preferably a light emitting diode, an electroluminescent panel, a light bulb or any other suitable light emitting device. The sound emitting device is preferably a piezo buzzer, a transducer, a mylar speaker or the like. The vibration sensor 34 detects that the shuttlecock 1 in motion and sends an electrical signal to the electrical controller 40. In response to the electrical signal, the electrical controller 40 activates the at least one light emitting device 36 and/or the sound emitting device 38, until the shuttlecock 1 is no longer in motion.

The tail base 24 with the tail 10 secured thereto is preferably attached to a top of the first housing half 26 with a fastener 44 and a nut 46. The first housing half 26 includes a first inner cavity (not shown) and the second housing half 28 includes a second inner cavity 48 both for retaining the electrical circuit 30. The first and second housing halves are preferably attached to each other with at least two fasteners 50 and at least two nuts 52. The impact head 14 preferably includes a plurality head discs 54, a plurality of buffer discs 56 and a disc strap 58.

The buffer discs 56 are preferably fabricated from open cell foam, closed cell foam, rubber, cardboard, corrugated material or any other suitable material. The head discs 54 are preferably fabricated from a plastic sheet material, such as ethylene vinyl acetate (EVA), polyvinyl chloride (PVC) or any other suitable plastic sheet material. At least one buffer disc 56 may be inserted between two head discs 54. However, some impact head designs do not include the plurality of buffer discs 56. A pair of slots 60 are formed through the plurality of head discs 54 and buffer discs 56. Each end of the disc strap 58 is inserted through the pair of slots 60. The disc strap 58 is pulled tight and inserted through the second housing half 28. A fastener 62 is inserted through the first and second ends of the disc strap 58 and threaded into a bottom of the second housing half 28. The disc strap 58 is used to hold the plurality of head discs 54 and buffer discs 56 to together to create the impact head 14. However, the first and second ends of the disc strap 58 may also be attached directly to the second housing 28 with any suitable method such as hooks, without the need for the fastener 62.

Figure 4:
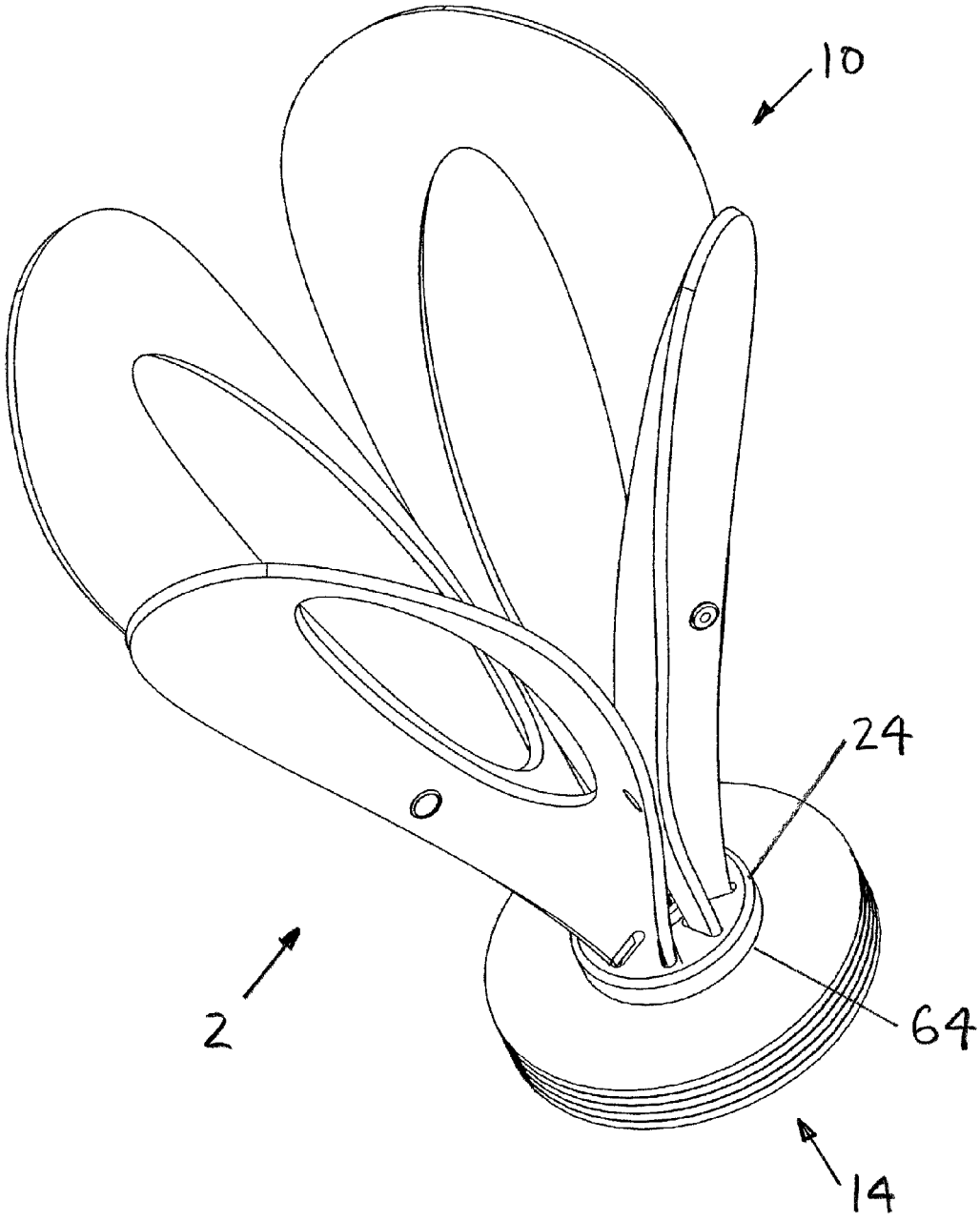
FIG. 4 is a perspective view of a second embodiment of a shuttlecock in accordance with the present invention.
Figure 5:
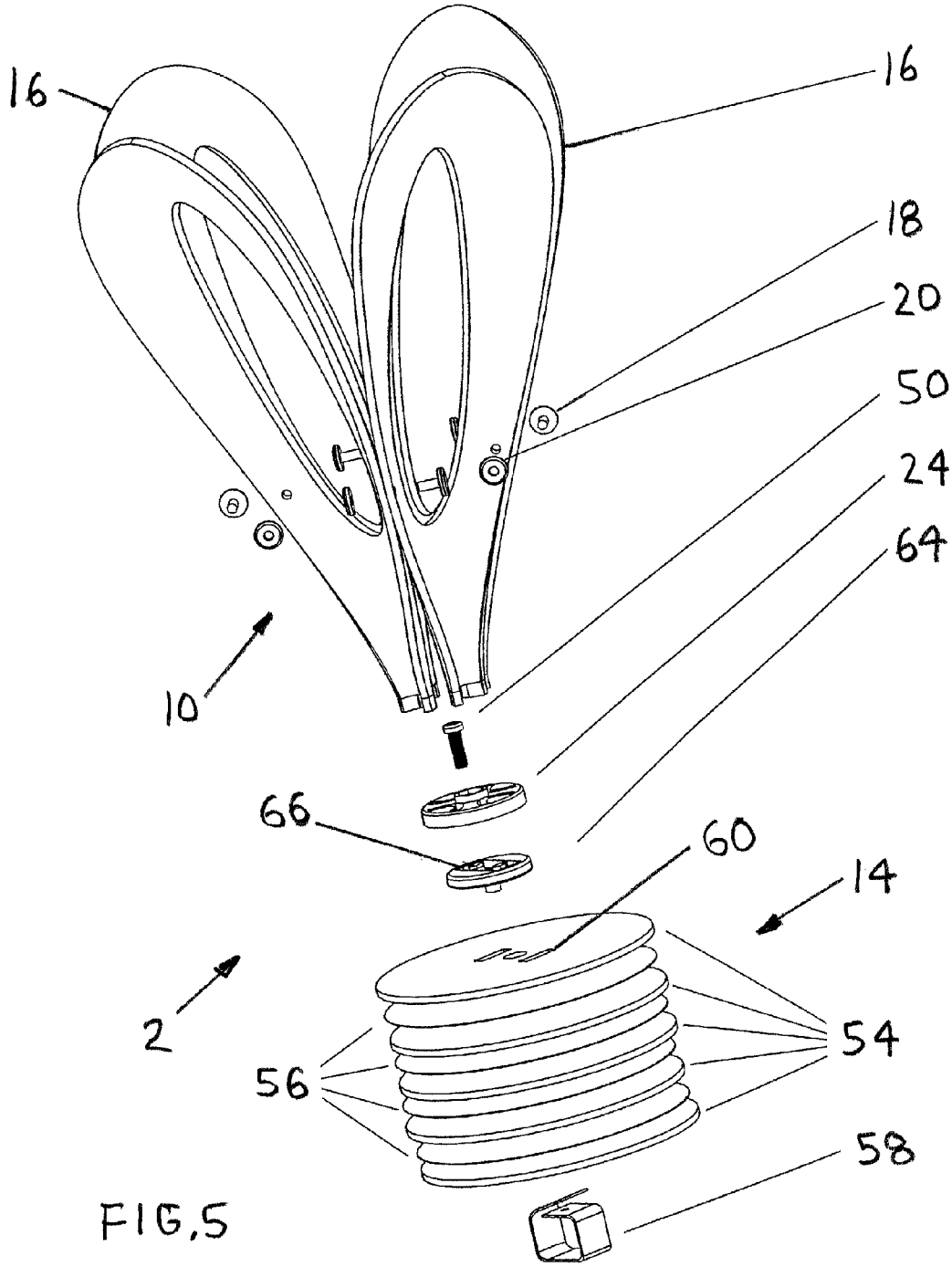
FIG. 5 is an exploded perspective view of a second embodiment of a shuttlecock in accordance with the present invention.

With reference to FIGS. 4-5, a second embodiment of the shuttlecock preferably includes the tail 10, a strap retainer 64 and an impact head 14. The tail 10 preferably includes the at least three tail sections 16. Each tail section 16 is preferably attached to an adjacent tail section 16 along a length thereof with the at least one lock pin 18 inserted into the at least one lock pin base 20. Each tail section 16 preferably includes the at least one opening 22 to reduce weight and improve aerodynamics. The end of each tail section 16 is retained in the tail base 24 by press-fit, adhesive or any other suitable method.

The impact head 14 preferably includes the plurality head discs 54, the plurality of buffer discs 56 and the disc strap 58. At least one buffer disc 56 is inserted between two head discs 54. However, some impact head designs do not include the plurality of buffer discs 56. The pair of slots 60 are formed through the plurality of head discs 54 and buffer discs 56. Each end of the disc strap 58 is inserted through the pair of slots 60. The disc strap 58 is pulled tight and inserted through slots 66 in the strap retainer 64. The fastener 50 is preferably inserted through holes in the first and second ends of the disc strap 58 and threaded into the strap retainer 64 to join the tail 10 and the impact head 14. However, the first and second ends of the disc strap 58 may be attached to each other and the fastener 50 inserted through holes in the first and second ends of the disc strap 58, and then threaded into the impact head 14. Further, the first and second ends of the disc strap 58 may also be attached directly to the strap retainer 64 with any suitable method such as hooks.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shuttlecock comprising:

a tail includes at least three tail sections;

an electrical circuit including an electrical controller, a vibration sensor and an indication device;

an impact head for receiving impact, wherein said electronic controller receives a signal from said vibration sensor when said shuttlecock is placed in motion, said electrical controller activating said indication device, when said shuttlecock is placed in motion; and a housing includes a first housing half and a second housing half, said electrical circuit is retained between said first and second housing halves, said tail extends from one end of said housing, said impact head extends from the other end of said housing.

2. The shuttlecock of claim 1, further comprising:

a tail base for retaining one end of said at least three tail sections, said tail base is secured to said one end of said housing.

3. The shuttlecock of claim 1 wherein:

said indication device is at least one of a light emitting device and a sound emitting device.

4. The shuttlecock of claim 1, further comprising:

said impact head includes a plurality of head discs and means for securing said plurality of heads to form said impact head.

5. The shuttlecock of claim 4, further comprising:

said impact head further includes a plurality of buffer discs, at least one of said plurality of buffer discs is inserted between two of said plurality of head discs.

6. The shuttlecock of claim 5, further comprising:

a disc strap is inserted through said plurality of buffer discs and said plurality of head discs to form said impact head.

7. A shuttlecock comprising:

a tail includes at least three tail sections, at least one opening is formed through at least one of said at least three tail sections;

an electrical circuit including an electrical controller, a vibration sensor and an indication device;

an impact head for receiving impact, wherein said electronic controller receives a signal from said vibration sensor when said shuttlecock is placed in motion, said electrical controller activating said indication device, when said shuttlecock is placed in motion; and a housing includes a first housing half and a second housing half, said electrical circuit is retained between said first and second housing halves, said tail extends from one end of said housing, said impact head extends from the other end of said housing.

8. The shuttlecock of claim 7, further comprising:

a tail base for retaining one end of said at least three tail sections, said tail base is secured to said one end of said housing.

9. The shuttlecock of claim 7 wherein:

said indication device is at least one of a light emitting device and a sound emitting device.

10. The shuttlecock of claim 7, further comprising:

said impact head includes a plurality of head discs and means for securing said plurality of heads to form said impact head.

11. The shuttlecock of claim 10, further comprising:

said impact head further includes a plurality of buffer discs, at least one of said plurality of buffer discs is inserted between two of said plurality of head discs.

12. The shuttlecock of claim 11, further comprising:

a disc strap is inserted through said plurality of buffer discs and said plurality of head discs to form said impact head.

13. A shuttlecock comprising:

a tail includes at least three tail sections, each one of said at least three tail sections being attached to an adjacent one of said at least three tail sections along a length thereof;

a tail base for retaining one end of said at least three tail sections;

an impact head for receiving impact, said impact head includes a plurality of head discs and a disc strap, said strap disc is inserted through said plurality of head discs;

a strap retainer includes two strap openings and a threaded tap, both ends of said disc strap are inserted through said two strap openings; and a fastener is inserted through said tail base and threaded into said threaded tap to assembly said tail to said impact head, both ends of said disc strap are retained between said tail base and said strap retainer.

14. The shuttlecock of claim 13, further comprising:

said impact head further includes a plurality of buffer discs, at least one of said plurality of buffer discs is inserted between two of said plurality of head discs.

15. The shuttlecock of claim 13, further comprising:

a first opening is formed through a first end of said disc strap, a second opening is formed through a second end of said disc strap, said fastener is inserted through said first and second openings before being threaded into said threaded tap.

* * * * *